US005121724A

United States Patent [19]

Anzai et al.

[11] Patent Number: 5,121,724

[45] Date of Patent: Jun. 16, 1992

[54] MULTI-CYLINDER INTERNAL COMBUSTION ENGINE WITH INDIVIDUAL PORT THROTTLES UPSTREAM OF INTAKE VALVES

[75] Inventors: Makoto Anzai; Toshimi Abo, both of Yokohama, Japan

[73] Assignee: Nissan Motor Company, Ltd., Japan

[21] Appl. No.: 612,693

[22] Filed: Nov. 15, 1990

[30] Foreign Application Priority Data

Nov. 16, 1989 [JP] Japan ..... 1-296072
Mar. 5, 1990 [JP] Japan ..... 2-53404

[51] Int. Cl.[5] ..... F02D 9/00
[52] U.S. Cl. ..... 123/336
[58] Field of Search ..... 123/336, 347, 339, 585, 123/399, 361, 432

[56] References Cited

U.S. PATENT DOCUMENTS

| | | | |
|---|---|---|---|
| 4,616,621 | 10/1986 | Kuroiwa et al. | 123/585 |
| 4,617,890 | 10/1986 | Kobayashi et al. | 123/339 |
| 4,649,877 | 3/1987 | Yasuoka et al. | 123/339 |
| 4,662,334 | 5/1987 | Wietschorke et al. | 123/585 |
| 4,840,159 | 6/1989 | Matsumoto | 123/585 |
| 4,841,935 | 6/1989 | Yamada et al. | 123/432 |
| 4,958,614 | 9/1990 | Truzzi et al. | 123/585 |
| 5,010,862 | 4/1991 | Hashimoto et al. | 123/585 |
| 5,010,863 | 4/1991 | Ishida et al. | 123/339 |

FOREIGN PATENT DOCUMENTS

| | | | |
|---|---|---|---|
| 55-148932 | 11/1980 | Japan | 123/336 |
| 57-180123 | 11/1982 | Japan | 123/336 |
| 62-178727 | 8/1987 | Japan | 123/336 |
| 1-61429 | 4/1989 | Japan | 123/336 |
| 1-151715 | 6/1989 | Japan | 123/336 |
| 1-151716 | 6/1989 | Japan | 123/336 |
| 1-163429 | 6/1989 | Japan | 123/336 |

OTHER PUBLICATIONS

SAE Technical Paper Series 880388.
SAE Technical Paper Series 890679.

*Primary Examiner*—Raymond A. Nelli
*Attorney, Agent, or Firm*—Lowe, Price, LeBlanc & Becker

[57] ABSTRACT

A throttle is disposed in the intake port per cylinder. At idle, the throttles are closed. The pressure in the intake port per cylinder increases during the intake valve closed period due to flow admitted to the intake port downstream of the throttle until it recovers to ambient before the valve overlap period. The flow rate is controlled individually per cylinder such that it is higher during the intake valve closed period than it is during the intake valve opened period. This allows the increased valve overlap to be used without increasing the residual mass fraction in the cylinder. As a result, the stability engine operation at idle and part load range is improved.

7 Claims, 17 Drawing Sheets

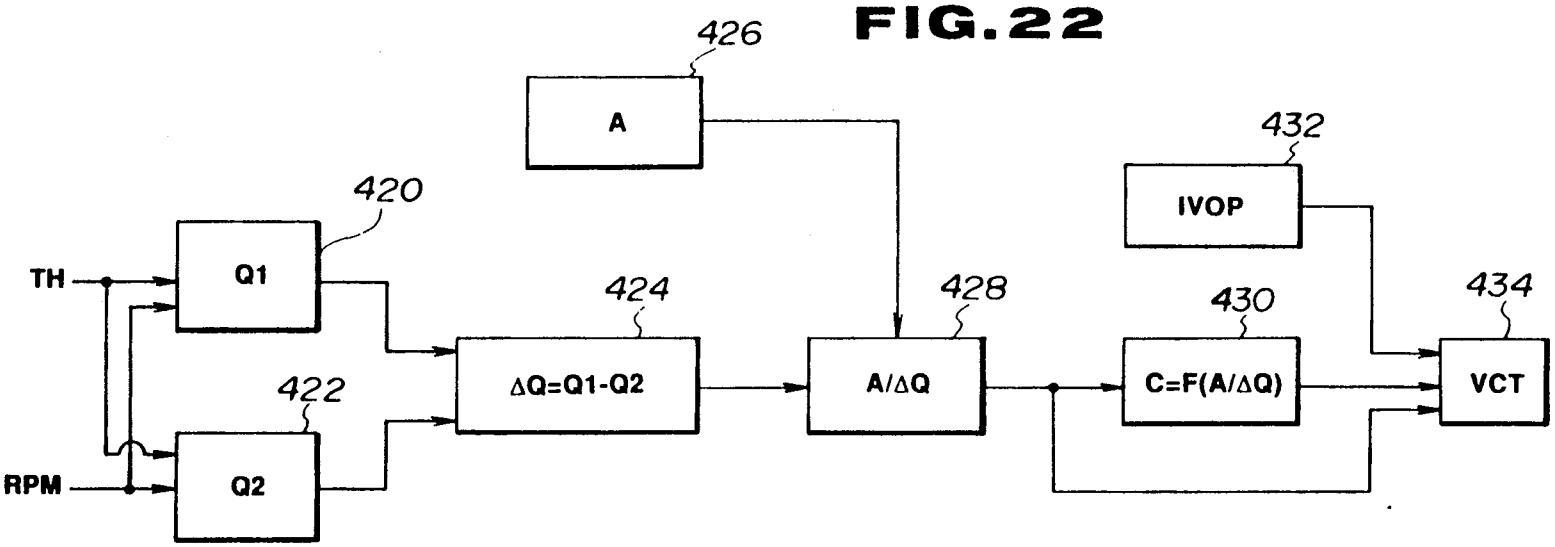
FIG.22
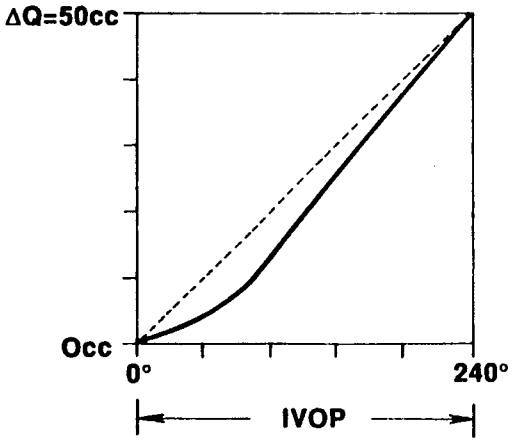
FIG.23
| C | 0 | 1.09 | 1.08 | 1.04 | 1.02 | 1.00 |
|---|---|---|---|---|---|---|
| A/ΔQ | 0.0 | 0.2 | 0.4 | 0.6 | 0.8 | 1.0 |
FIG.24

MULTI-CYLINDER INTERNAL COMBUSTION ENGINE WITH INDIVIDUAL PORT THROTTLES UPSTREAM OF INTAKE VALVES

BACKGROUND OF THE INVENTION

The present invention relates to a multi-cylinder internal combustion engine with individual port throttles located upstream of intake valves.

In a spark ignition internal combustion engine, pumping loss increases when the engine load is reduced. Without throttling, control of engine load can be realized by variation of intake valve opening period. Variable valve timing is proposed in the publication "SAE Technical Paper Series 880388" entitled "Variable Valve Timing-A Possibility to Control Engine Load without Throttle." In this publication, a rotary side valve is located in the intake port upstream of an intake valve (see FIG. 2*d* of the above-mentioned publication). In this system, phase of valve timing of the rotary side valve is varied. The size of the port volume is small so that the port pressure recovers to near ambient levels during the intake valve closed period. If the size of the port volume downstream of the rotary side valve is large, a throttle needs to be located upstream of the rotary side valve (see FIG. 9 of the above-mentioned publication). With this throttle, the pressure upstream of the rotary side valve is kept below the ambient levels, thus allowing charge control by the rotary side valve with sacrifice of pumping loss reduction.

The series connection of a rotary side valve with an intake valve is a promising system. However, a disadvantage of this system is derived from the use of the rotary side valve. At idle engine operation, high vacuum is created in the cylinder at the bottom dead center. Thus, the poor tightness of the rotary side valve causes problems with the charge control. Furthermore, mechanical losses due to a mechanism for actuating the rotary side valves will increase. No satisfactory solution is yet found which allows individual cylinder control.

Load control with port throttle is proposed in the publication "SAE Technical Paper Series 890679" entitled "The Effects of Load Control with Port Throttling at Idle-Measurements and Analyses." With port throttling, the pressure in the intake port increases during the intake valve-closed period due to flow past the throttle. The pressure in the port increases to ambient before the valve overlap period so that back flow into the intake system from the cylinder is eliminated. This allows increased valve overlap to be used without increasing the residual mass fraction in the cylinder. The application of this concept to multi-cylinder internal combustion engines with port fuel injection necessitates a precision fit of the throttles in order to reduce cylinder-to-cylinder variability of air flow and air-fuel ratio over the idle and part load range of engine operation.

Laying-open Japanese Utility Model Application 1-61429 discloses a multi-cylinder internal combustion engine wherein a throttle is located upstream of intake ports of cylinders, and an air injection nozzle is arranged for each of the ports to inject a jet of air into the corresponding port in order to suppress back flow into the intake system from the cylinder during the valve overlap period. This air injection is intended to improve idle stability of a multi-cylinder internal combustion engine with increased valve overlap. If the amount of air injected is excessive and inducted into the cylinder during the valve overlap period, the change within the cylinder increases, resulting in an increase in idle speed. Thus, the amount of air injected must be so calibrated as not to result in a considerable increase in idle speed.

Laying-open Japanese Patent Application No. 55-148932 discloses rotary valves located upstream of inlet valves of cylinders, and a mechanism for actuating the rotary valves.

An object of the present invention is to improve a multi-cylinder internal combustion engine such that air flow to each cylinder is controlled to reduce pumping work during the induction process over idle and part load range of engine operation.

A further object of the present invention is to improve a multi-cylinder internal combustion engine such that, with a less complicated mechanism, air flow to each cylinder is controlled to reduce pumping work during the induction process over idle and part load range of engine operation.

A further object of the present invention is to improve a multi-cylinder internal combustion engine such that air flow to each cylinder is controlled to reduce pumping work during the induction process at idle engine operation without any undesirable increase in idle speed.

A further object of the present invention is to improve a multi-cylinder internal combustion such that cylinder-to-cylinder variability of output torque is reduced over idle and part load range of engine operation.

SUMMARY OF THE INVENTION

Accoridng to the present invention, a throttle, which may be directly or indirectly connected to a manually operable accelerator or gas pedal, is provided for each of cylinders and located upstream of an intake valve for the cylinder. An effective flow area of air admitted downstream of each from the throttles is controlled such that, when the throttle is substantially closed, the effective flow area is larger during the intake valve closed period than it is during the intake valve opened period.

According to a first embodiment of the present invention, the throttles are bypassed by individual bypass passages, each having a second valve with a solenoid operated actuator. The second valves are independently actuated under the control of a control unit in accordance with a predetermined control strategy. Each of the second valves has a first state providing a relatively large effective flow area in the bypass passage, and a second state providing a relatively small effective flow area. Fuel injectors are located upstream of the intake valves, respectively. With the control strategy, when the throttle is substantially closed, the second valve is fully opened to provide the relatively large effective flow area in the bypass passage, allowing pressure in the intake port to increase and recover to ambient before the valve overlap period. Subsequently, it changes it state to provide the relatively small effective flow area, restricting the flow past the bypass passage during the intake valve opened period. The relatively small effective flow area is varied in such a direction to decrease a deviation of actual engine speed from a target engine speed. In order to reduce cylinder-to-cylinder variability in output torque, cylinder pressure per each cylinder is sampled over a plurality of consecutive cycles to calculate cylinder average; the cylinder averages of all of the cylinders are added and divided by the number of the cylinders to give total average, and a deviation of the cylinder average from the total average is calculated per each cylinder. This deviation is also taken into account in varying the relatively small effective flow area.

Flow rate through each of the bypass passages becomes low as the throttles are opened in accordance with the degree of depression of the accelerator pedal owing to resistance of the bypass passage. Thus, according to a second embodiment, the throttles for individual cylinders have second valves arranged in the intake ports in parallel. The second valves do not have any passages extending in the flow direction, thus providing less resistance than the bypass passages do. Besides, the throttles remain closed when the degree of depression of the accelerator pedal is between zero and a predetermined degree so as to induce a sufficient pressure drop across the second valves. Thus, load control with the second valves is effective over zero and small accelerator pedal depression range of engine operation.

If a change in idle speed is needed, the relatively small effective flow area is varied by actuating the second valve. According to a third embodiment, this flow area is increased to allow an increase in idle speed when a vehicle mount air conditioner is turned on.

In the previously mentioned embodiments, the load control is effected by varying the relatively small effective flow area without changing a shift timing of the second valves from the first state providing the relatively large effective flow area to the second state providing the relatively small effective flow area. According to a fourth embodiment, the shift timing of the second valve from the first state to the second state occurs in the induction process and it is varied to effect load control.

According to a fifth embodiment, as different from the first embodiment, control for suppressing the cylinder-to-cylinder variability of output torque is effected after processing data sampled during start-up and warming-up range of engine operation where the engine operation is deemed stable, while, at normal idle engine operation, the variability suppressing control is effected after processing data stored during the variability suppressing control over start-up and warming-up range of engine operation. This is because if the variability of data sampled at the normal idle condition becomes great, the idle stability is hampered.

According to a sixth embodiment, an actual air flow admitted to each of the cylinders during the induction process is calculated as a function of an actual fuel flow to the cylinder and an actual A/F determined per cylinder, and a target air flow for each of the cylinders is calculated as a function of the actual fuel flow and a target A/F. Independent control of air flow to individual cylinders is effected to bring the actual air flow per cylinder into agreement with the target air flow per cylinder.

BRIEF DESCRIPTION OF THE DRAWINGS

FIG. 2(*b*) shows port pressure diagrams for the second valve left in the first state (see fully drawn curve A), for the second valve left in the second state (see fully drawn curve B), and for the second valve subject to cyclic shift (see broken line curve C) as shown in FIG. 2(*a*);

FIG. 5(*b*) is a timing chart illustrating the timing when an A/D converter is to be initiated;

FIG. 7(*b*) is a timing chart showing a top dead center of number one cylinder CYL#1 in the compression process;

FIG. 7(*c*) is a timing chart showing the timing when the A/D converters are to be initiated in a predetermined sequence;

FIG. 7(*d*) is a timing chart showing the timing when execution of a reference job shown in FIG. 8 is to be initiated after interrupting execution of a background job shown in FIG. 10;

FIG. 22 a block diagram;

FIG. 23 is a chart illustrating actual gain in intake air during the intake valve opening period (IVOP); and FIG. 24 depicts table data.

DETAILED DESCRIPTION OF THE INVENTION

The multi-cylinder internal combustion engine has four combustion chambers, each defined by a cylinder which is closed at one end and has a movable piston at the other end. The four cylinders are in line and their four pistons, respectively are connected to a common crankshaft. Each cylinder has a fuel injector valve. The mixture of air and fuel in each cylinder is compressed by the piston and ignited by an electric spark near the end of the compression stroke.

Figure 1:
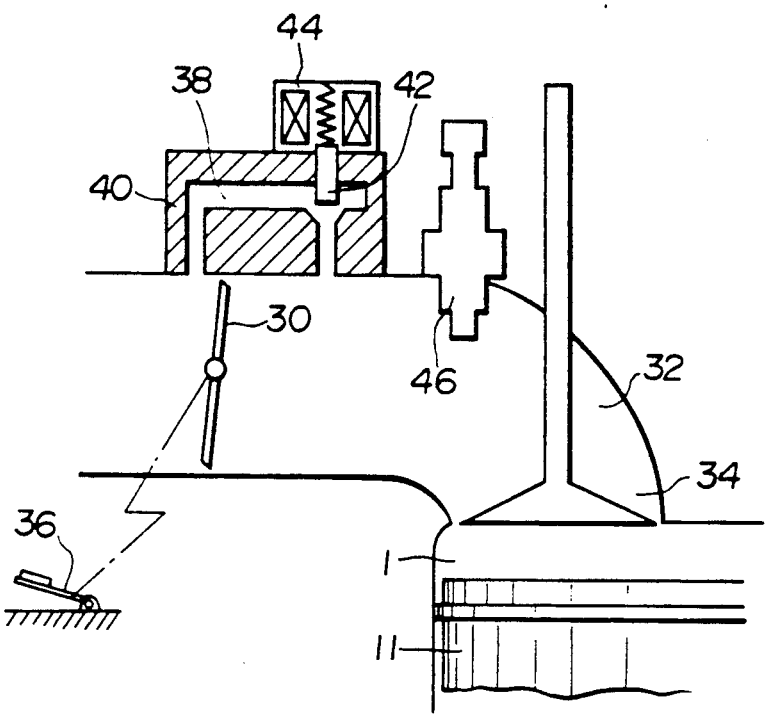
FIG. 1(A) is a schematic view of an air intake system.
FIG. 1(B) is a side schematic view of a multi-cylinder internal combustion engine.
Figure 1:
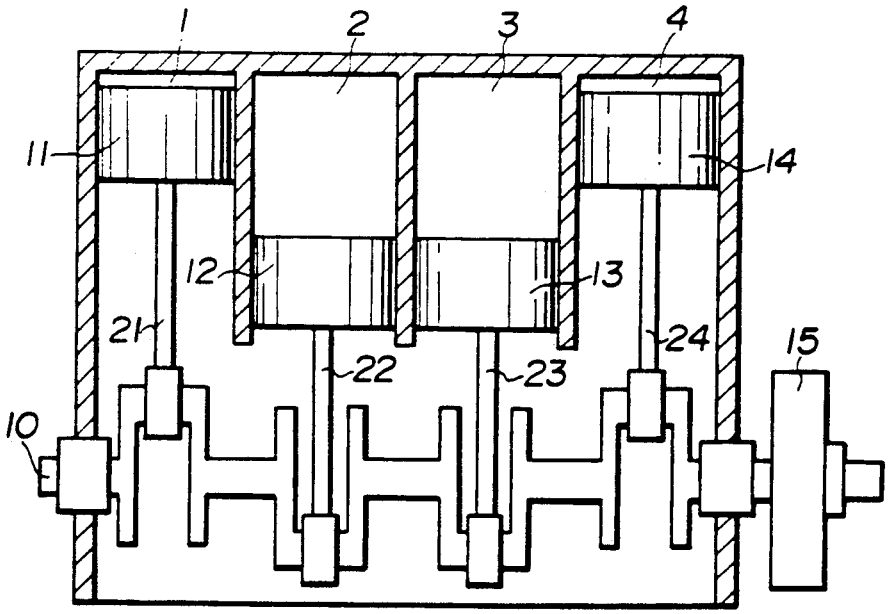

Referring to FIG. 1(B), four cylinders 1 to 4 are respectively fitted with pistons 11 to 14 connected to crankshaft 10 by means of connecting rods 21 to 24. Flywheel 15 is mounted to one end of the crankshaft 10 and rotates therewith. Power or expansion strokes in the different cylinders are timed in the order of 1-4-3-2 with consecutive power strokes being spaced apart by 180° of crankshaft travel. One of the intake systems is shown in FIG. 1(A).

Referring to FIG. 1(A), a throttle 30 is mounted in an intake port 32 and located upstream of an intake valve 34. The throttle 30 is directly or indirectly connected to an accelerator or gas pedal 36 such that the opening degree of the throttle is proportional to the degree of depression of the accelerator which is manually operable. A conventional actuating system may be employed to actuate the throttles. The throttle 30 is bypassed by a bypass passage 38 of an adaptor 40 mounted on the intake port 32. A second valve 42 with a solenoid operated actuator 44 is disposed in the bypass passage 38. A fuel injector valve 46 is mounted on the intake port 32 to spray fuel through the intake port to form an air fuel mixture in the cylinder. The second valve 42 is actuated under the control of a control unit shown in FIG. 3 in accordance with a predetermined control strategy. This control strategy is illustrated in FIG. 2(*a*).

Figure 2A:
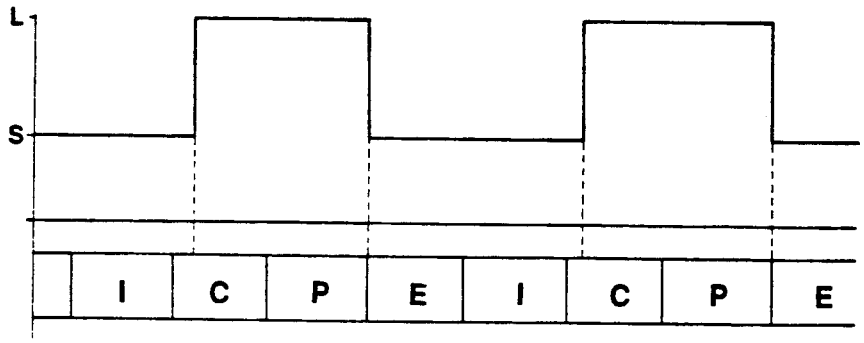
FIG. 2(*a*) is a timing chart showing in schematic form a valve closing timing diagram when a second valve shifts from a first or fully opened state providing a relatively large effective flow area (L) to a second or restricted state providing a relatively small effective flow area (S) and a valve opening timing diagram when the second valve shifts back to the first state from the second state.
Figure 2B:
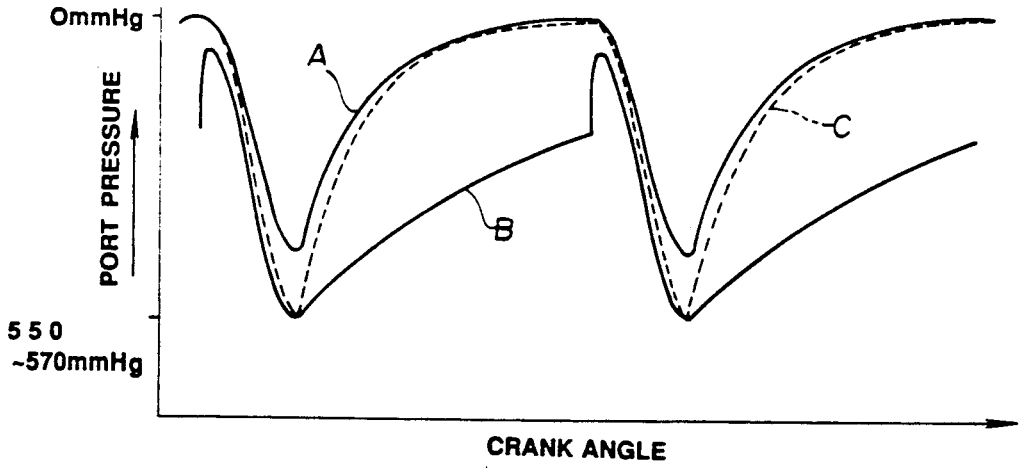

Referring to FIG. 2(*a*), the induction stroke is designated by the reference character I, the compression stroke by C, the power or expansion stroke by P, and the exhaust stroke by E. In FIG. 2(*a*), the variation in the effective flow area in the bypass passage 38 is illustrated as a function of the operation of cylinder 1 at idle condition when throttle 30 is substantially closed. The second valve 42 has a first state providing a relatively large effective flow area denoted by a level at L and a second state providing a relatively small effective area denoted by a level at S. In accordance with the control strategy, the second valve 42 is fully opened to provide the relatively large effective flow area L in the bypass passage 38, allowing pressure in the intake port, i.e., port pressure, to increase and recover to ambient before the valve overlap period. Subsequently, the second valve 42 shifts to the second state providing the relatively small effective flow area S, restricting the air flow past the bypass passage 38 during the valve opened period of the intake valve 34. Specifically reference to FIG. 2(*a*), the second valve 42 is shifted from the first state providing the relatively large effective flow area L to the second state providing the relatively small effective flow area S before the intake valve 34 is opened, and it is shifted back to the first state providing the relatively large effective flow area L after the intake valve 34 is closed. Variation in port pressure at idle condition is explained along with FIG. 2(*b*).

Referring to FIG. 2(*b*), broken line curve C illustrates the variation in port pressure when the second valve 42 is actuated in accordance with the control strategy illustrated in FIG. 2(*a*). As seen from the curve C, the port pressure increases and recovers to ambient (0 mmHg) before the intake valve is opened and drops to a desired low value (between 550 and 570 mmHg). The port pressure is ambient at the beginning of the induction stroke, resulting in a considerable reduction in pumping work in the induction stroke. Flow of air is restricted during the induction process, the volume of charge in the cylinder at the end of the induction stroke becomes an appropriate value for idle engine operation. In order to accomplish the desired variation in port pressure as illustrated by the curve C, it is essential to set the volume of intake port downstream of the throttle, i.e., port volume, smaller than one half (½) of the maximum volume of the combustion chamber at the end of the induction stroke.

In FIG. 2(*b*), curve A shows the variation in port pressure if the second value is left in the first state which provides the relatively large effective flow area L. As seen from this curve A, the port pressure recovers to ambient at the beginning of the induction stroke, but it does not sufficiently drop to the desired low value at the end of the induction stroke, resulting in an increase in idle speed.

In FIG. 2(*b*), curve B shows the variation in port pressure if the second valve is left in the second state (i.e., the relatively small effective flow area S). As depicted, the port pressure fails to recover to ambient at the beginning of the induction stroke. Comparing curve C with curves A and B, it will be appreciated that with the second valve actuated in accordance with the control strategy shown in FIG. 2(*a*), the pumping work in the induction stroke is reduced without causing any undesirable increase in engine speed at idle condition.

Figure 3:
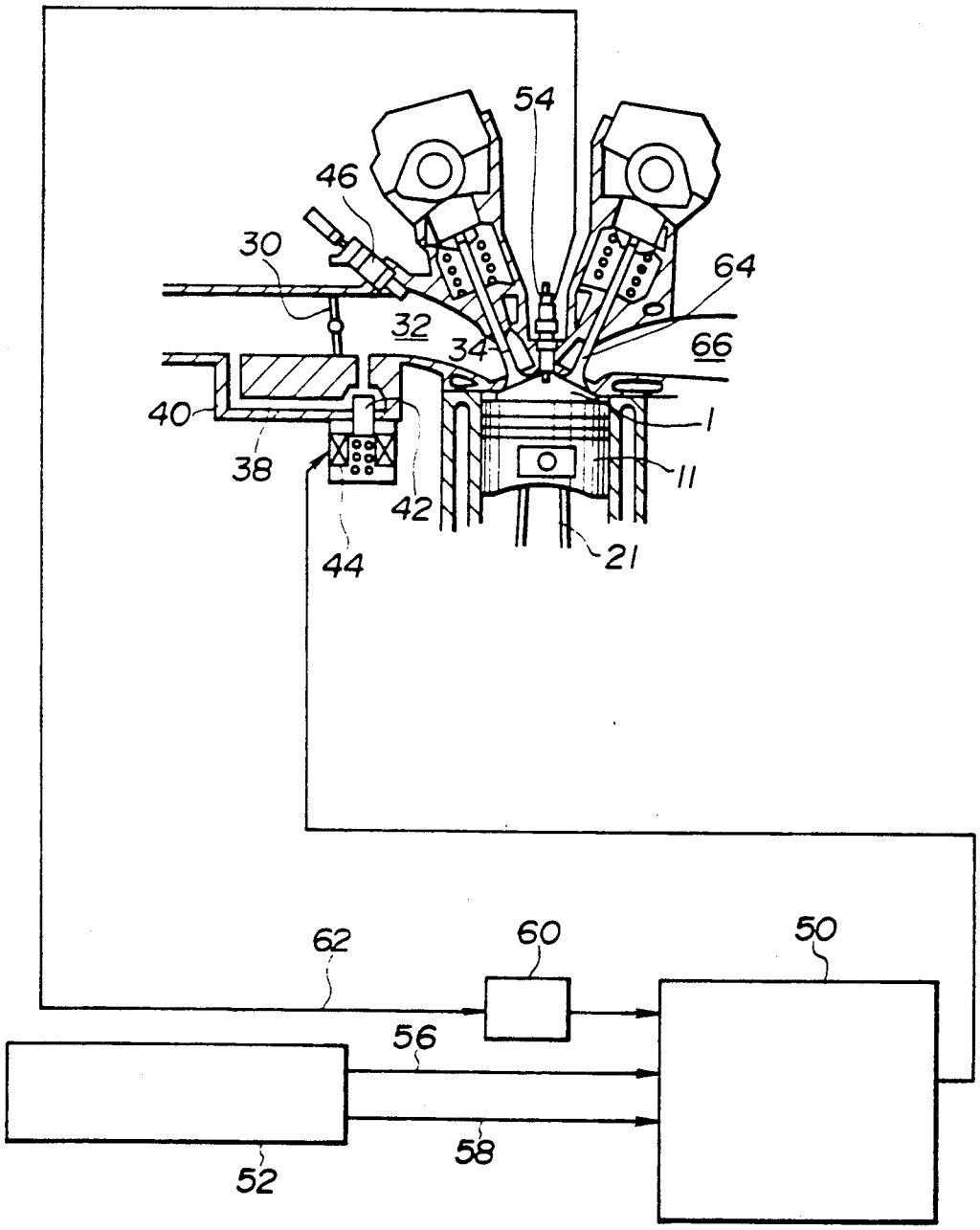
FIG. 3 shows a control system including a microcomputer based control unit.

From the preceding description, it is readily seen that if the area of the relatively small effective flow area S of the second value is varied per cylinder, cylinder-to-cylinder variability of output torque is reduced. FIG. 3 shows a control system for the solenoid actuators, only one being shown at 44.

Referring to FIG. 3, a microcomputer based control unit 50 controls the drive signals supplied to solenoid actuators, only one being shown at 44, for the second valves, only one being shown at 42, for different cylinders. A crank angle sensor 52 is mounted on the engine and generates, as a reference signal, a 180° signal and, as a crank angle signal, a 1° signal. A spark plug 54 with a cylinder pressure sensor (not shown) is mounted to each cylinder and generates an analog signal indicative of cylinder pressure. The reference signal is supplied to the control unit 50 along a line 56, while the crank angle signal is supplied to the control unit 50 along a line 58. The analog signal of the cylinder pressure sensor is supplied to a A/D converter 60 along a line 62. When initiated, the A/D converter 60 feeds a digital signal output indicative of the analog signal of the cylinder pressure to the control unit 50. In FIG. 3, an exhaust valve 64 and an exhaust port 66 for the cylinder 1 are shown. The information processing performed by the control unit 50 is illustrated in FIG. 4.

Figure 4:
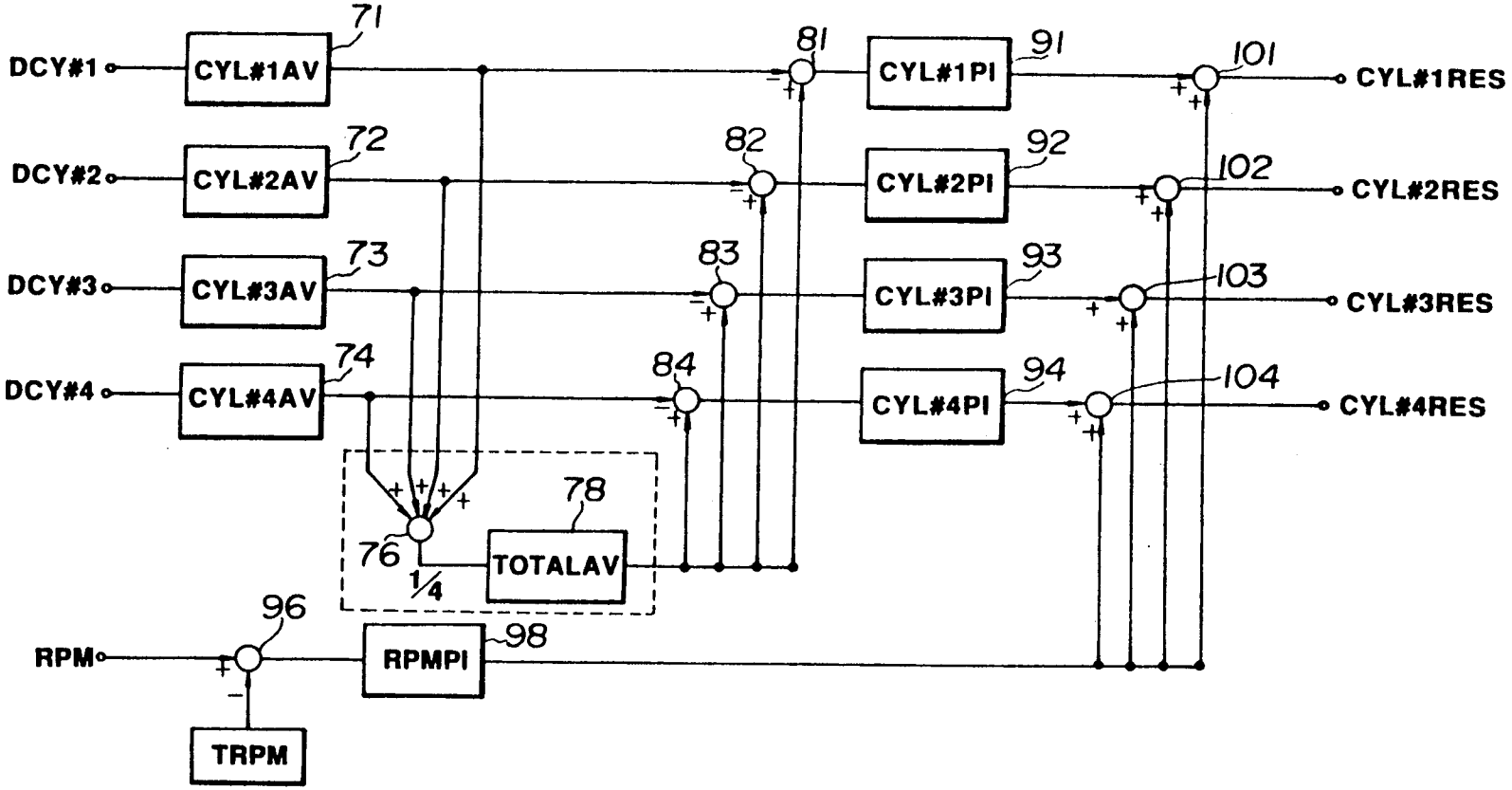
FIG. 4 is a block diagram illustrating data processing to be performed in the control unit.

Referring to FIG. 4, DCYL#1 to DCYL#4 indicate cylinder pressure data at top dead center of the compression stroke of the cylinders 1 to 4. At blocks 71 to 74, four cylinder pressure data per cylinder are sampled during the eight crankshaft revolutions of engine operation and the total of the four sampled data is divided by four (4) to give cylinder averages CYL#1AV to CYL#4AV. These cylinder averages CYL#1AV to CYL#4AV are added together and divided by four (4) at an arithmetic junction to give a result as a total cylinder average TOTALAV at a block 78. At arithmetic junctions 81 to 84, the cylinder averages are subtracted from the total average TOTALAV to give cylinder variations CYL#1VAR to CYL#4VAR. At PI blocks 91 to 94, a proportional term and an integral term are calculated from the cylinder variations to give PI values CYL#1PI to CYL#4PI. At an arithmetic junction 96, a target engine speed TRPM is subtracted from an actual engine speed RPM to give an engine speed variation RPMVAR. At a PI block 98, an integral term and a proportional term are calculated from the engine speed variation RPMVAR to give a PI value RPMPI. At arithmetic junctions 101 to 104, the PI values CYL#1PI to CYL#4PI are added to RPMPI to give actuator control values CYL#1RES to CYL#4RES for the different cylinders. Based on these actuator control values CYL#1RES to CYL#4RES, the relatively small effective flow rate areas S, see FIG. 2(*a*), are adjusted by modulating drive signals supplied to the actuators. The processing in the control unit 50 is more specifically described in connection with FIGS. 5(*a*) to 12.

Figures 5A, 5B:
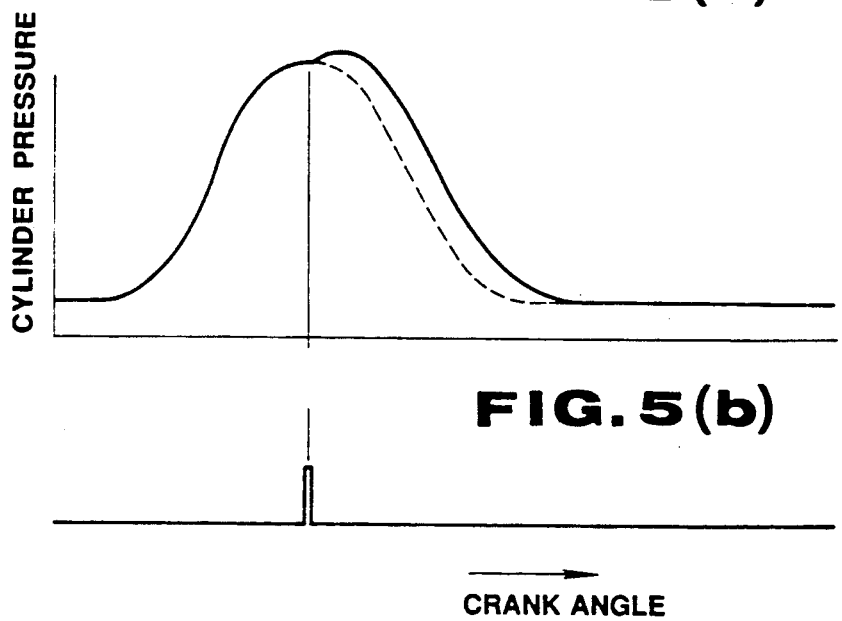
FIG. 5(*a*) is a cylinder pressure diagram when the cylinder is near top dead center in the compression process followed by normal combustion in the subsequent expansion process (see fully drawn line curve) and followed by non-combustion in the subsequent expansion process (see broken line curve)

The fully drawn curve in FIG. 5(*b*) shows cylinder pressure within one of cylinders when the cylinder is near top dead center in the compression stroke followed by normal combustion in the subsequent power stroke. FIG. 5(*b*) shows a timing when the A/D converter for the particular cylinder is to be initiated to convert the analog signal output of the cylinder pressure sensor to a digital signal. The timing when the A/D converter is to be initiated to effect A-D conversion is set by the reference job illustrated by the flow diagram shown in FIG. 8.

Figure 6:
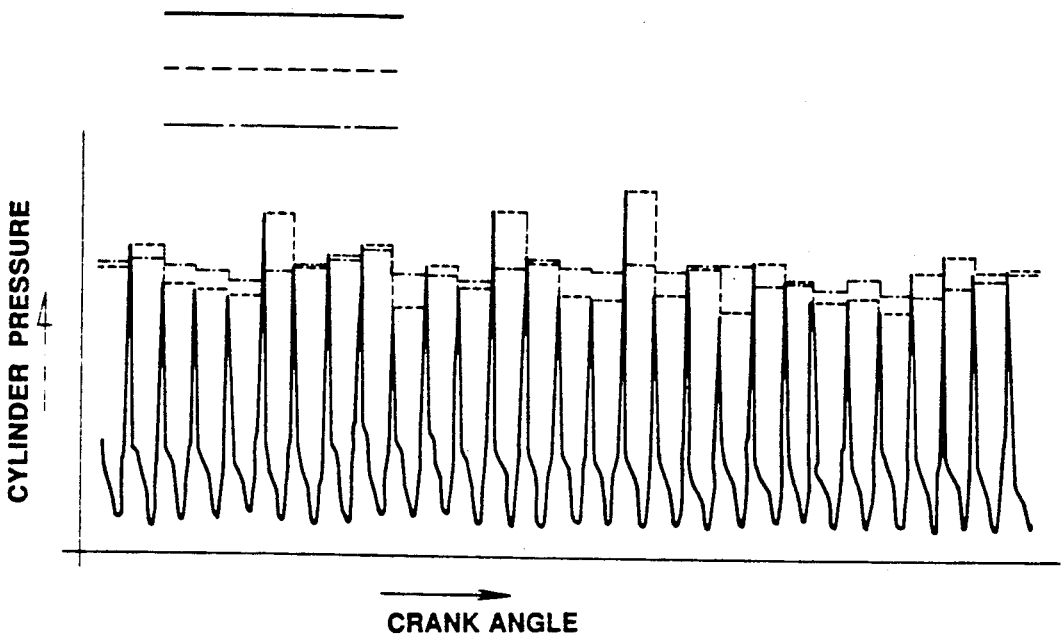
FIG. 6 shows variation of cylinder pressure at idle condition (see fully drawn line)
Figure 7:
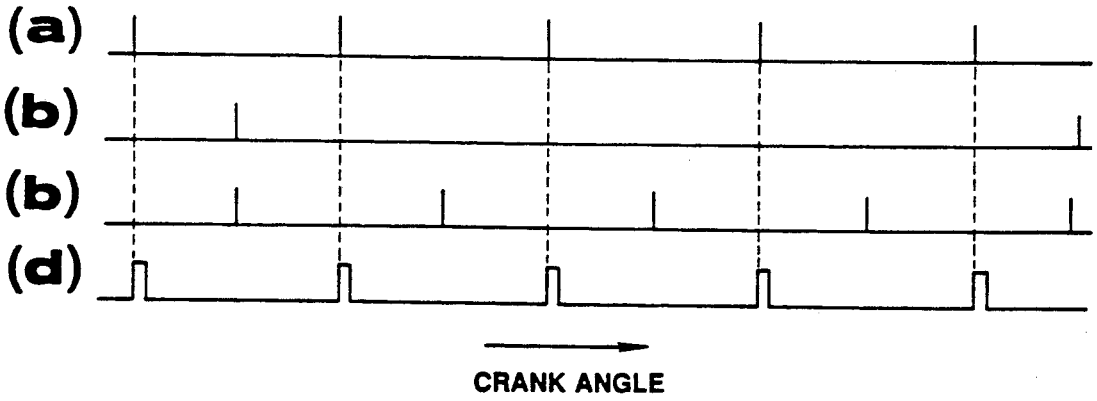
FIG. 7(*a*) shows a train of 180° signals of a crank angle sensor.
Figure 8:
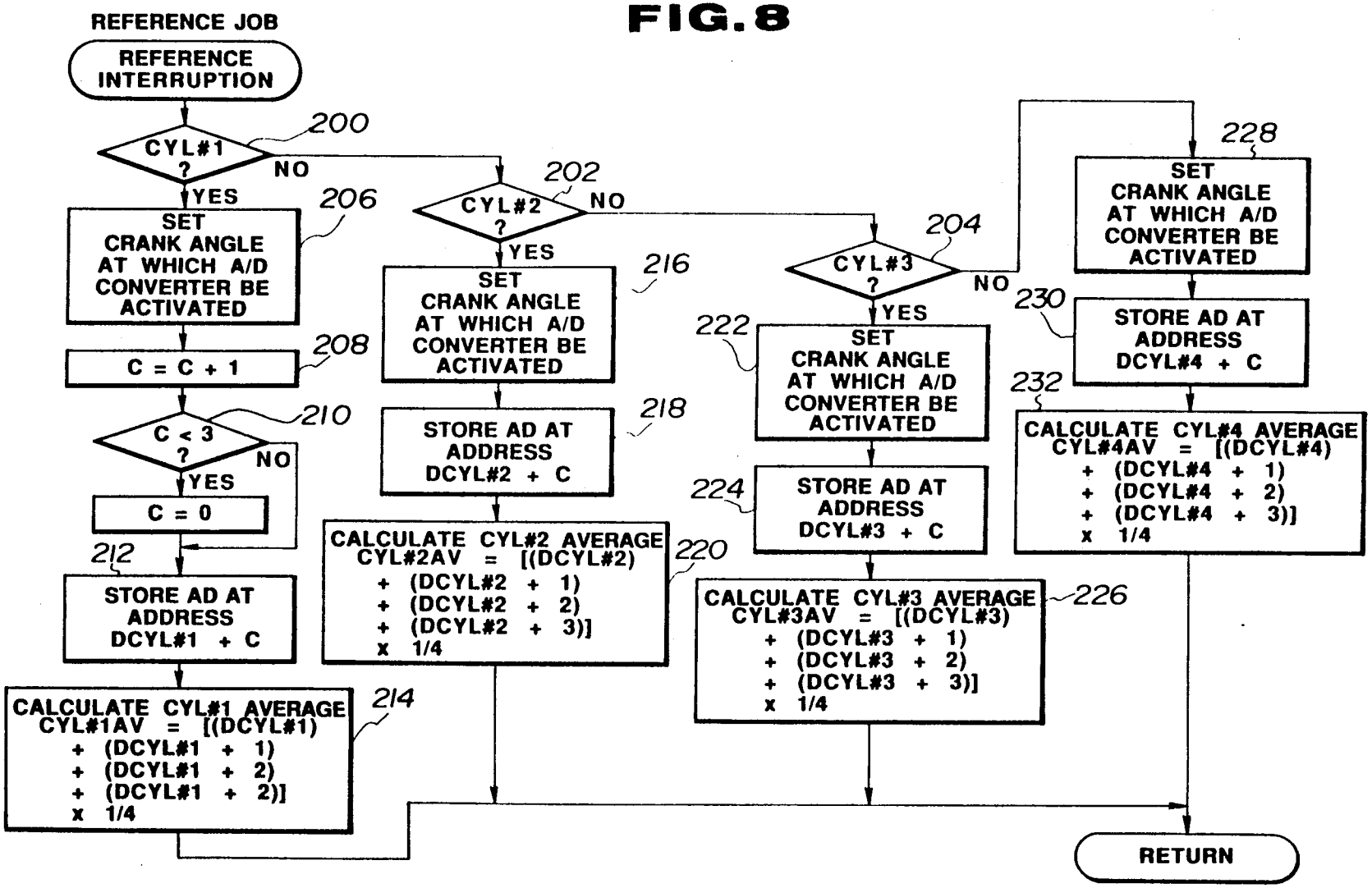
FIG. 8 is a flow diagram of the reference job which is initiated after interruption of the background job shown in FIG. 10 upon generation of the reference signal by the crank angle sensor.

The fully drawn line shown in FIG. 6 shows cylinder pressure in number one cylinder 1 at idle condition. The broken line in FIG. 6 shows stored cylinder pressure data CYL#1, CYL#1+1, CYL#1+2, and CYL#1+3 per the cylinder, and one-dot-chain line shows the cylinder pressure average CYL#1AV for the cylinder. FIG. 7(*a*) shows a train of 180° signals generated by the crank angle sensor 52 at idle condition. FIG. 7(*b*) is a timing chart showing top dead center of cylinder 1 in the compression stroke. FIG. 7(*c*) is a timing chart showing the timing when the A/D converters are to be initiated in a predetermined sequence. FIG. 7(*d*) is a timing chart showing the timing when execution of the reference job shown in FIG. 8 is to be initiated after interrupting execution of a background job shown in FIG. 10. FIGS. 8, 9, 10, and 12 show flow diagrams of programs stored in ROM of the microcomputer based control unit 50. The function performed at the blocks 71 to 74 shown in FIG. 4 is performed by execution of programs shown in FIGS. 8 and 9.

Figure 9:
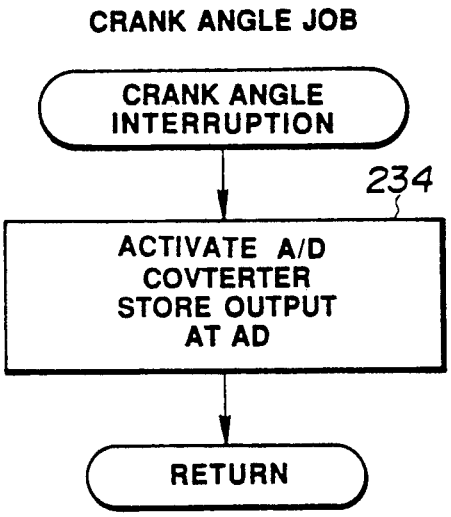
FIG. 9 is a flow diagram of a crank angle job which is executed after interruption of the background job shown in FIG. 10 in accordance with the timing chart shown in FIG. 7(*c*)
Figure 11:
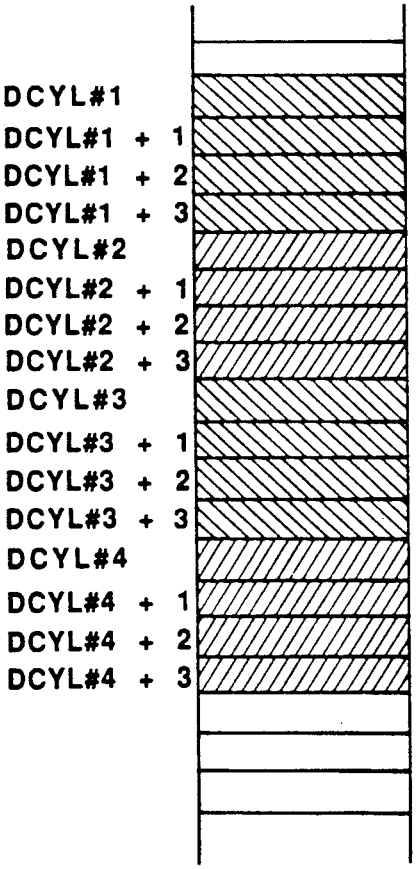
FIG. 11 illustrates an arrangement of memory location in a RAM (random access memory) where the sampled data are to be stored.
Figure 10:
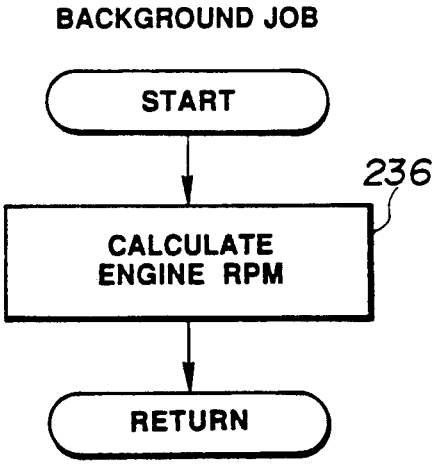
FIG. 10 is a flow diagram of the background job.

Referring to FIG. 8, execution of this program is initiated after interrupting the background job shown in FIG. 10 upon generation of the reference signal. At judgment steps 200, 202, and 204, it is determined which one of the cylinders is about to enter the compression stroke. If, for example, the number one cylinder 1 is at the top dead center position of the induction stroke, the program proceeds to a step 206 where a timing at which the A/D converter is to be activated is set in terms of a crank angle. Then, the program proceeds to a step 208 where a counter C is increased by one (1) and then to a judgment step 210 where it is determined whether the content of the counter C is greater than three (3) or not. If the content of C is one (1), the answer to the inquiry at the step 210 is negative and thus the program proceeds to a step 212 where the output AD1 of the A/D converter is stored at a memory location in the RAM identified as DCYL#1+1. The content of the counter C changes 1-2-3-0-1. . . cyclically and thus new output values A/D are stored at different memory locations DCYL#1+2, DCYL #1+3, and DCYL#1 in that order. At a step 214, the cylinder average CYL#1AV for the number one cylinder 1 is calculated by dividing the total of the four sampled data DCYL#1, DCYL#1+1, DCYL#1+2, and DCYL#1+3 by four (4). Similarly, the cylinder averages CYL#2AV, CYL#3AV, and CYL#4AV are calculated at steps 220, 226, and 232 after sampling four data for each of the other cylinders by executing steps 216, 218, 222, 224, 228, and 230. When the crankshaft travels to the crank angles set at the step 206, 216, 222, and 218, execution of the program shown in FIG. 9 is initiated to activate the A/D converters for the cylinders 1, 4, 3, and 2 and store the output of this A/D converter at AD1, AD4, AD3, and AD2 in that order. The contents of AD1, AD2, AD3, and AD4 contains data indicative of cylinder pressure values measured in the compression stroke of the cylinders 1, 2, 3 and 4, respectively. The arrangement of memory locations is illustrated in FIG. 11.

Figure 12:
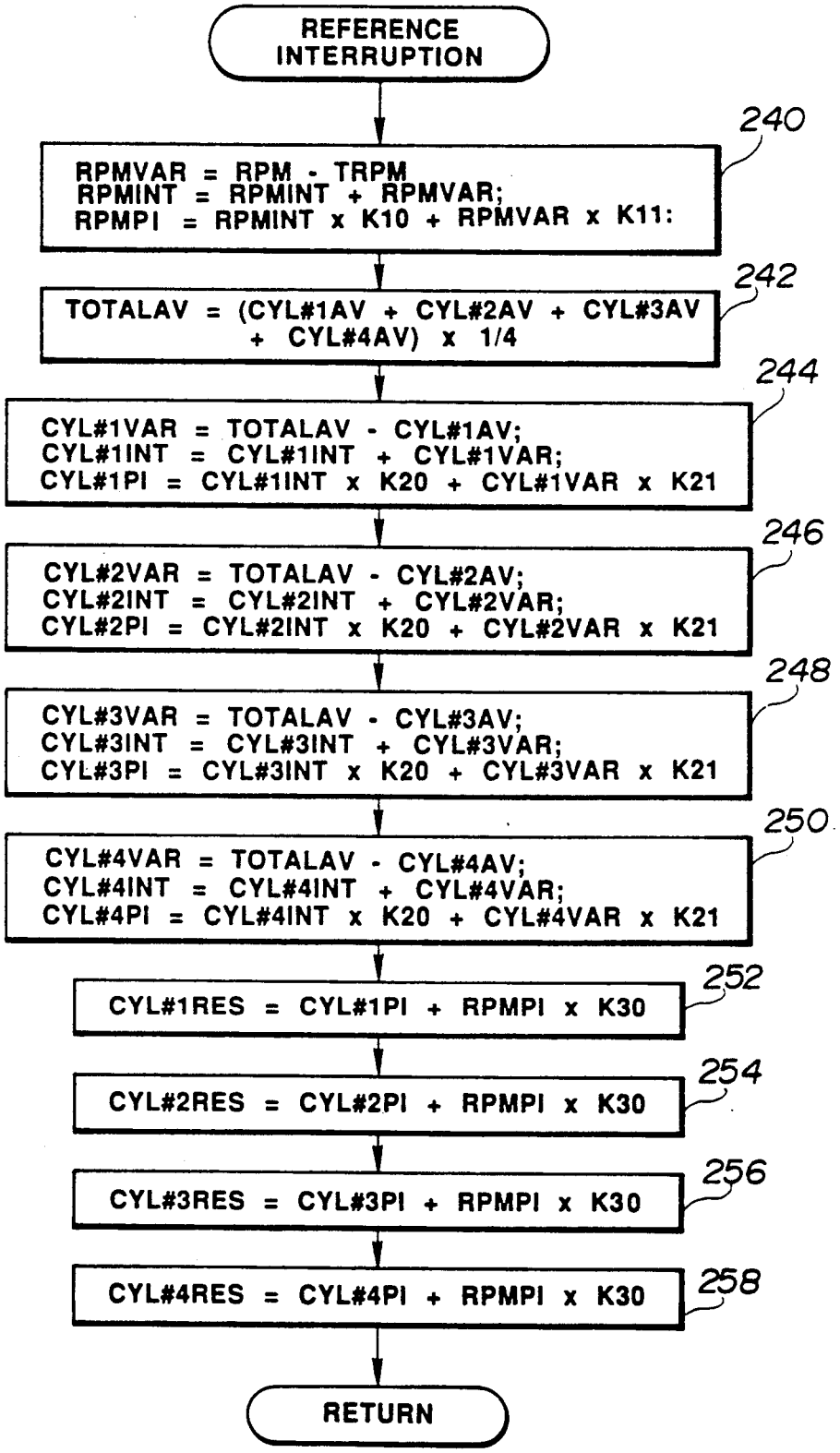
FIG. 12 is a flow diagram of another reference job which is to be executed after execution of the reference job shown in FIG. 8.

Referring back to FIG. 4, the functions mentioned in connection with the block 98, block 78, arithmetic junctions 81 to 84, blocks 91 to 94, and arithmetic junctions 101 to 104 are performed by executing programs shown in FIG. 10 and 12.

Referring to FIG. 10, the execution of this program is repeated at predetermined intervals. In FIG. 10, actual engine speed is determined based on frequency of the reference signal and stored at RPM at a step 236.

Referring to FIG. 12, the execution of this program is initiated after execution of the reference job shown in FIG. 8. At a step 240, engine speed variance or deviation RPMVAR and time integral of engine speed variance RPMIT are determined by calculating the following equations:

$$RPMVAR = RPM - TRPM, \text{ and}$$

$$RPMINT = RPMINT + RPMVAR,$$

where: TRPM is a target engine speed.

Also determined at the step 240 is a PI value RPMPI by calculating the following equation:

$$RPMPI = RPMINT \times K10 + RPMVAR \times K11,$$

where:

K10 is an integral gain, and

K11 is a proportional gain.

At a step 242, total average TOTAL is determined by calculating the following equation:

$$TOTALAV = (CYL\#1AV + CYL\#2AV + CYL\#3AV + CYL\#4AV) \times \tfrac{1}{4}.$$

Each of steps 224, 246, 248, and 250, cylinder pressure variances or deviations per cylinders CYL#1VAR, CYL#2VAR, CYL#3VAR, and CYL#4VAR, time integrals of cylinder pressure per cylinders CYL#1INT, CYL#2INT, CYL#3INT, and CYL#4INT, and PI values per cylinders CYL190 1PI, CYL#2PI, CYL#3PI, and CYL#4PI are determined. Taking the cylinder 1 for example, CYL#1VAR, CYL#1INT, and CYL#1PI are determined at the step 244 by calculating the following equations:

$$CYL\#1VAR = TOTALAV - CYL\#1AV,$$

$$CYL\#1INT = CYL\#1INT - CYL\#1VAR, \text{ and}$$

$$CYL\#1PI = CYL\#1INT \times K20 - CYL\#1VAR \times K21,$$

where:

TOTALAV is the total average of cylinder pressure averages,

CYL#1 AV is a cylinder average of numer one cylinder,

K20 is an integral gain, and

K21 is a proportional gain.

At each of steps 252, 254, 256, and 258, actuator control values per cylinders CYL#1RES, CYL#2RES, CYL#3RES, and CYL#4RES are determined. Taking the number one cylinder, for example, CYL#1RES is determined at the step 252 by calculating the following equation:

$$CYL\#1RES = CYL\#1PI + RPMPI \times K30.$$

where: K30 is a gain.

In the previously described embodiment, the flow rate through each of the bypass passages become low was the throttles are opened in accordance with the degree of depression of the accelerator pedal due to resistance of the bypass passage. Thus, according to the second embodiment illustrated in FIGS. 13 to 15, the throttles for individual cylinders have second or sub throttle values arranged in the intake ports in parallel.

Figure 13:
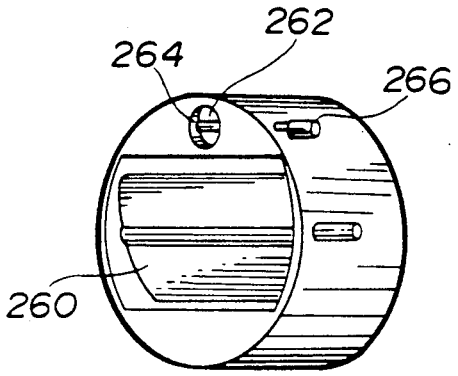
FIG. 13 is a diagram illustrating a portion of a second embodiment.
Figure 14:
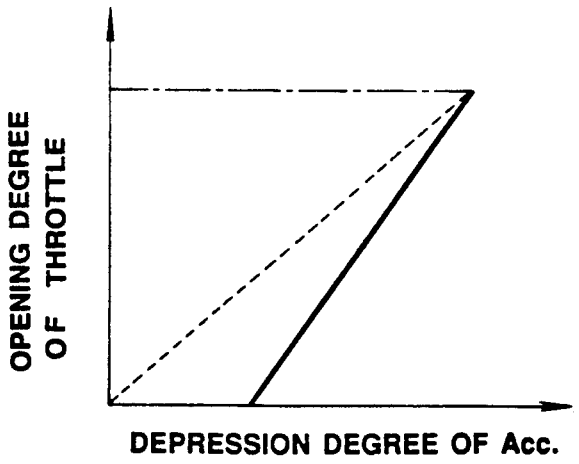
FIG. 14 is a chart illustrating the variation in throttle opening degree against accelerator depression degree.

Referring to FIG. 13, arranged in each of the intake ports are a throttle 260 and a second value in the form of a sub throttle 262. The sub throttle 262 is rotatable with a control rod 266 to vary the effective flow area of a bypass opening 264. Since it does not have any extension in the direction of flow through the intake port, the bypass opening 264 provides less resistance than does the bypass passage. The control rod 266 is coupled with a rotary actuator, not shown, which is controlled in a similar manner as the solenoid actuator was in the previously described embodiment. As shown by the fully drawn line in FIG. 14, each of the throttles 260 remains closed when the degree of depression of the accelerator pedal is between zero and a predetermined degree of the accelerator pedal so as to induce a sufficient pressure drop across the bypass opening 264. Thus, load control with the sub throttles 262 for the cylinders is effective from zero through a small accelerator pedal depression range of engine operation. In FIG. 14, the broken line curve shows the characteristic used in the previously described embodiment. By employing the characteristic as shown by the fully drawn line in FIG. 14, a modification is needed to the data processing. This modification is illustrated in FIG. 15.

Figure 15:
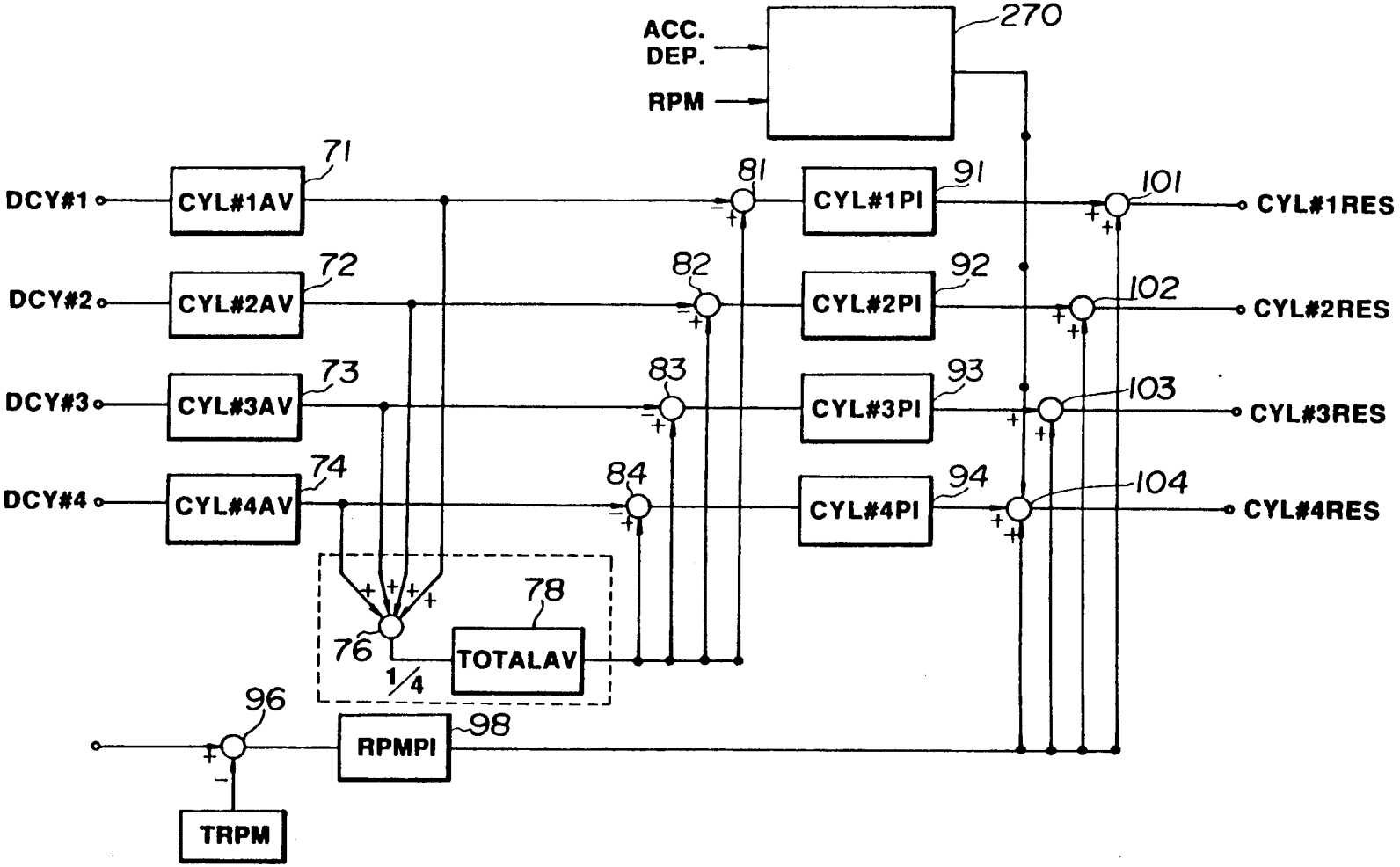
FIG. 15 is a block diagram similar to FIG. 4 illustrating data processing used in the second embodiment.

Referring to FIG. 15, this diagram is substantially the same as the diagram shown in FIG. 4 except the addition of correction values at arithmetic junctions 101 to 104. The correction values are mapped versus various values of engine speed and the depression degree of accelerator pedal. Table look-up of this map is executed at a block 270 based on the values of engine speed and the depression degree. The arrangement of the map is such that the correction value increases as the depression degree of the accelerator pedal increases, and as the engine speed increases.

Figures 16A, 16B, 16C:
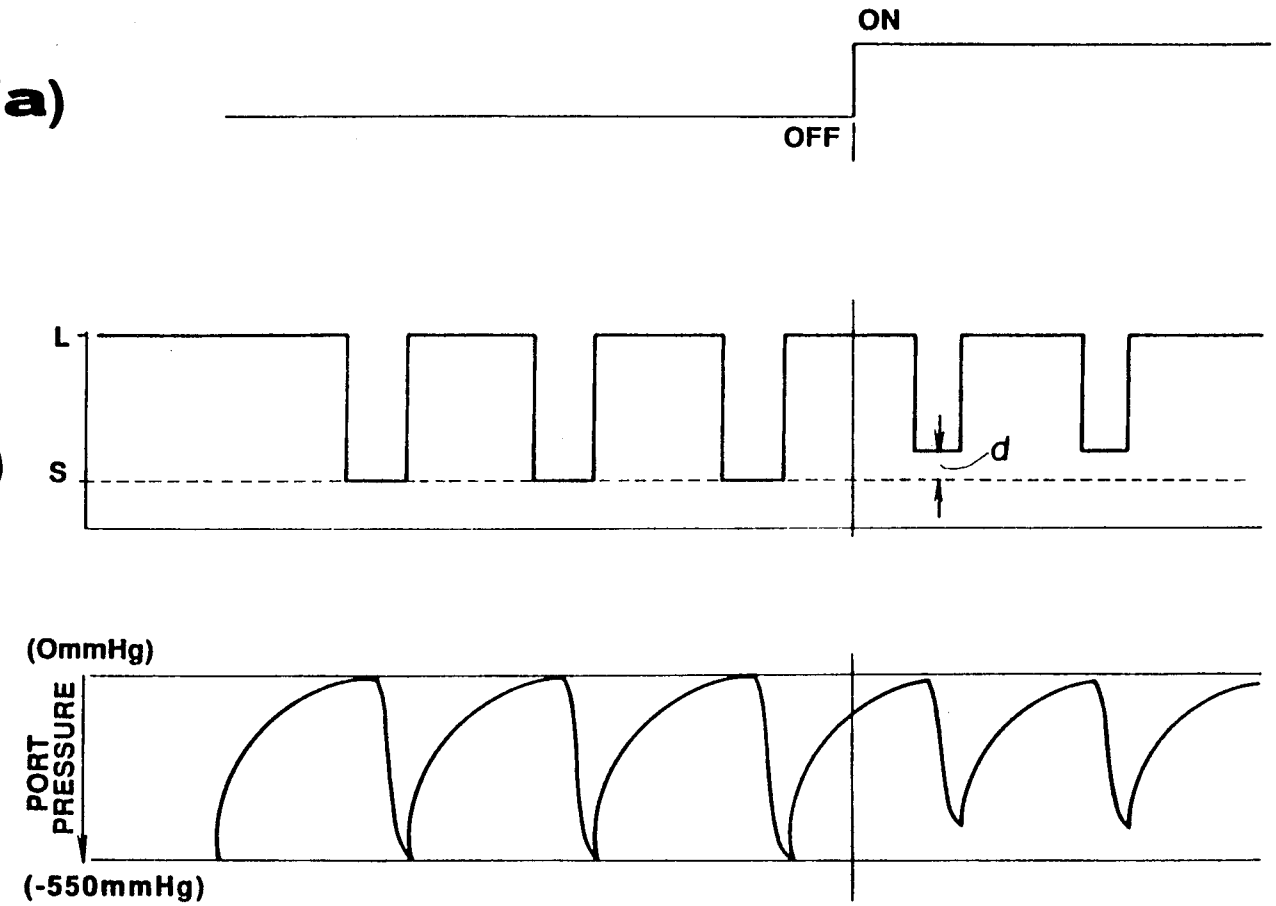
FIGS. 16(*a*), 16(*b*), and 16(*c*) are timing charts illustrating a feature of a third embodiment.

In the previously described embodiments, no consideration is made to a considerable disturbance. Namely, if a vehicle mounted air conditioner is turned on, there occurs, a need to increase the idle speed. The third embodiment deals with this problem. Referring to FIGS. 16(*a*), 16(*b*), and 16(*c*), the third embodiment is described.

FIG. 16(*b*) is a timing chart depicting how a second valve of each of the cylinders is actuated when the air conditioner switch is turned on as shown in FIG. 16(*a*). FIG. 16(*c*) is a time chart illustrating a port pressure diagram. As shown in FIG. 16(*b*), a relatively small effective flow area S is increased by d after the air conditioner has been turned on, allowing an increase in idle speed.

In the previously described embodiments, the load control is effected by varying the relatively small effectively flow area S of the second valve without changing the shift timing of this valve. According to the fourth embodiment, the valve shift timing of the second valve is varied to change the load as illustrated in FIGS. 17(*a*) and 17(*b*).

Figures 17A, 17B:
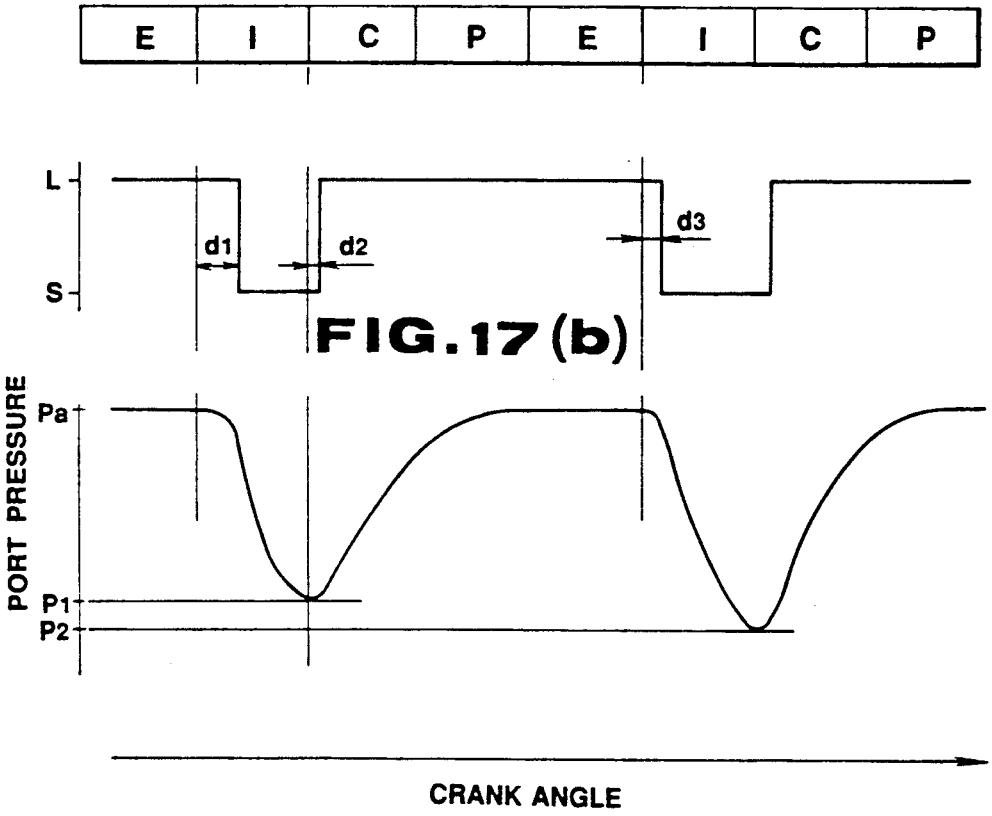
FIG. 17(*a*) and 17(*b*) are similar views to FIGS. 2(*a*) and 2(*b*) illustrating a feature of a fourth embodiment.

FIG. 17(*a*) shows the shift timing of the second valve from the first state (relatively large effective flow area L) to the second state (relatively small effective flow area S) occuring at the beginning of the induction stroke of each cylinder. In this example, this valve shift timing is varied to decrease the overlap from d1 to d3, causing a decrease in charge in the cylinder, resulting in a decrease in output torque of the cylinder.

Figure 18:
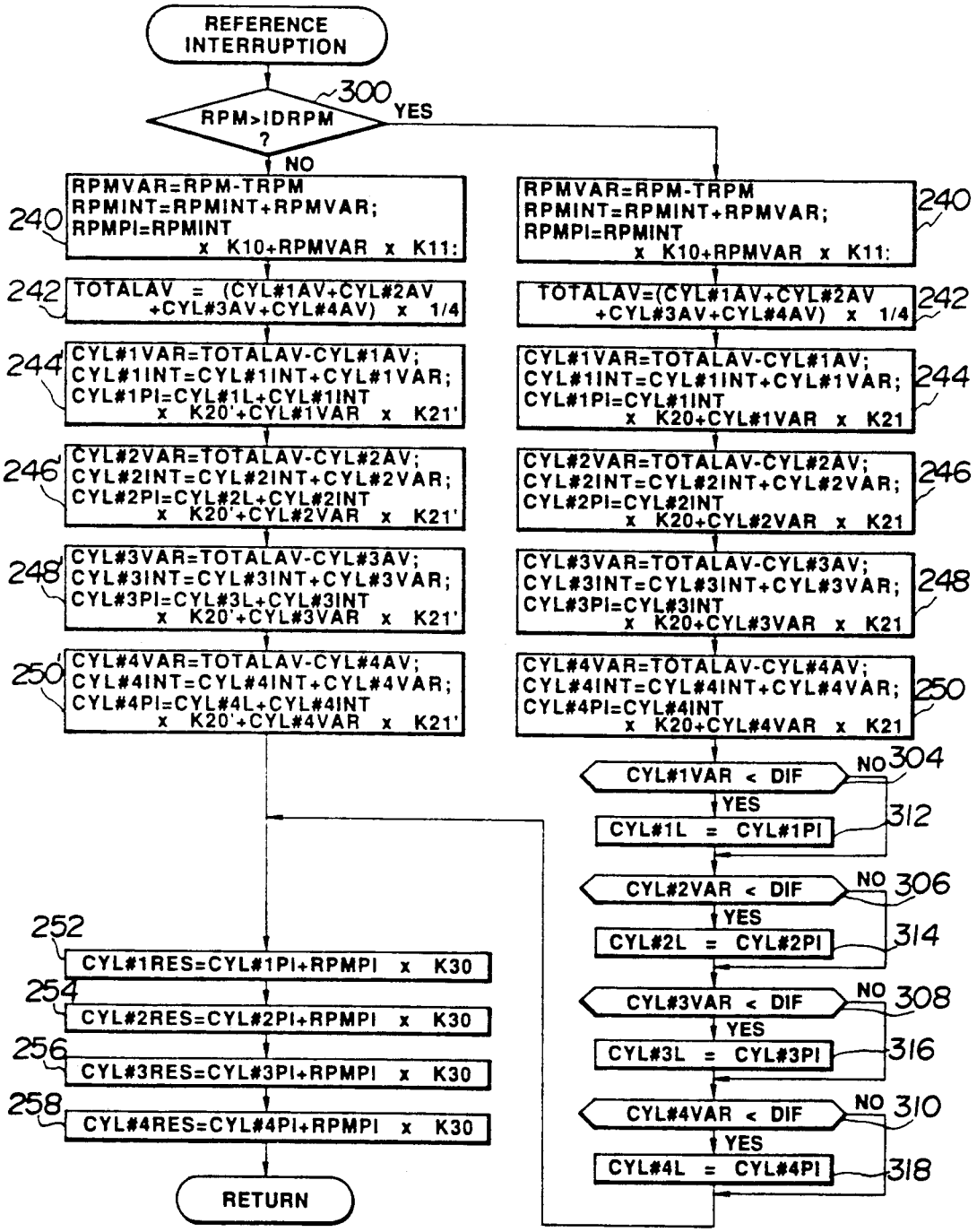
FIG. 18 is a flow diagram similar to FIG. 12, illustrating a feature of a fifth embodiment.

Referring to FIG. 18, the fifth embodiment is described. This embodiment is substantially the same as the first embodiment. According to the fifth embodiment, as different from the first embodiment, control for suppressing cylinder-to-cylinder variability of output torque is effected after processing data sampled during start-up and warming-up range of engine operation where the engine operation is stable, while, at normal idle engine operation, the variability suppressing control is effected based on data stored during the variability suppressing control having been performed over start-up and warming-up range of engine operation. This is because the engine operation at normal idle condition is less stable than the engine operation over start-up and warming-up range.

In FIG. 18, it is determined at a judgment step 300 whether the engine operation progresses over start-up and warming-up range or at normal idle condition. In this example, at the step 300, it is determined whether or not engine speed RPM is greater than a predetermined idle speed IDRPM. If an answer to the inquiry at the step 300 is affirmative, the program proceeds along steps 240, 242, 244, 246, 248, and 250. After executing these steps, CYL#1VAR, CYL#2VAR, CYL#3VAR and CYL#4VAR are compared with a predetermined value DIF. Taking for example the number one cylinder, if CYL#1 is less than DIF at the step 304, CYL#1PI obtained at the step 244 is stored at CYL#1L as a learning value at a step 312. If the inquiry at the step 304 is negative, the learning value CYL#1L is not updated. Learning values CYL#2L, CYL#3L, and CYL#4L are provided for the other cylinders and updated at steps 314, 316, and 318, respectively. These learning values CYL#1L, CYL#2L, CYL#3L, and CYL#4L are as gains in calculating CYL#1PI, CYL#2PI, CYL#3PI, and CYL#4PI at steps 244', 246', 248' and 250', respectively. These steps 244', 246', 248' and 250' are executed if the answer to the inquiry at the step 300 is negative, i.e., at normal idle condition. The step 244' is substantially the same as the step 244 except the equation used to calculate CYL#1PI. In the step 244', the equation CYL#1PI=CYL#1L+CYL#1INT×K20'-+CYL#1VAR×K21' is calculated in determining CYL#1PI. K20' and K21' are integral gain and proportional gain, respectively, which are set smaller than the gains K20 and K21 used in the step 244, and the learning value CYL#1L is added as a term. Similar difference exist between the steps 246' and 246, 248' and 248, and 250 and 250'. The control along with this flow diagram is effective in suppressing variability due to aging of the second valves.

Figure 19:
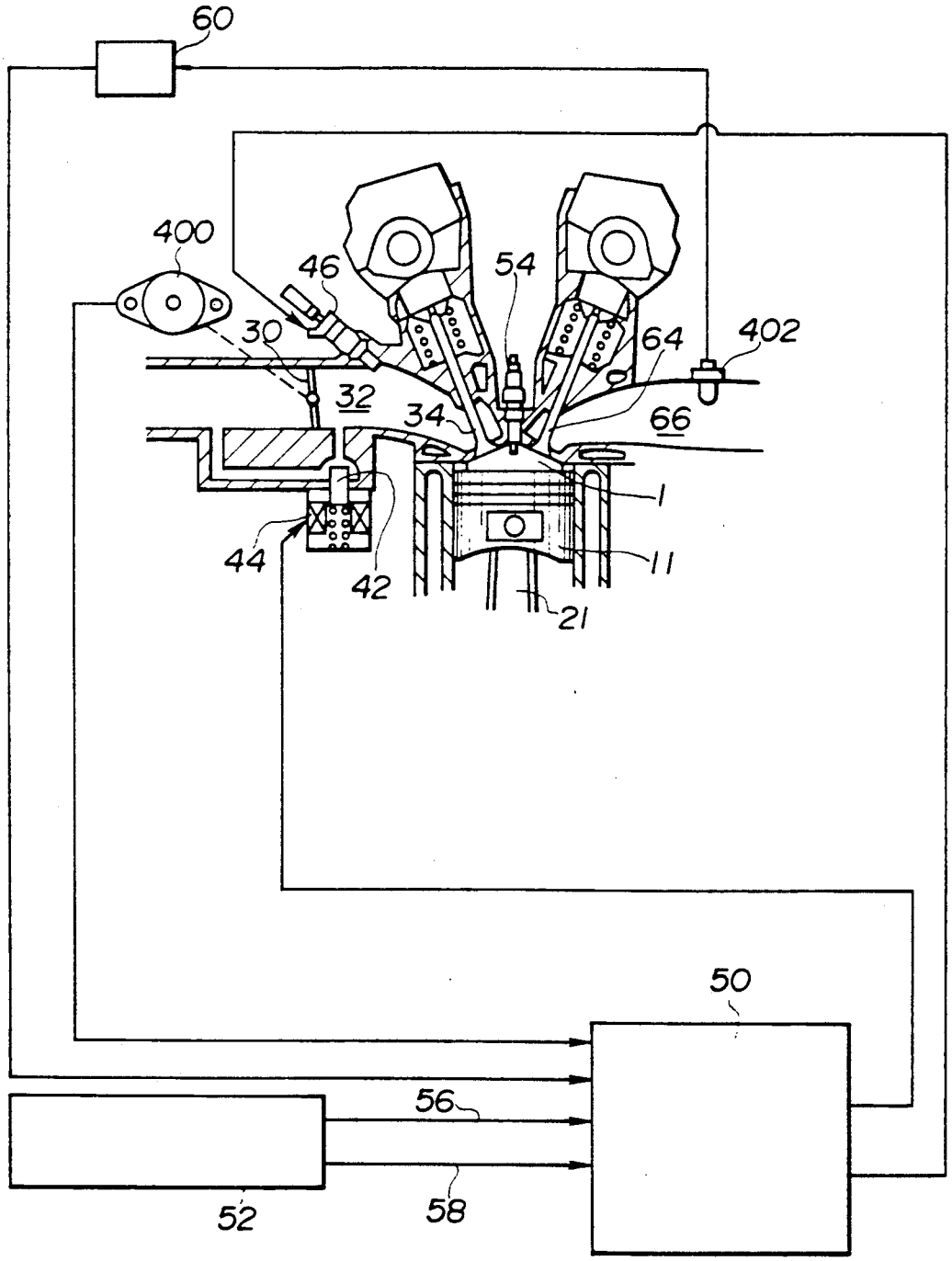
FIG. 19 is a similar view to FIG. 3 illustrating a sixth embodiment.

The sixth embodiment is illustrated in FIGS. 19 to 24. Referring to FIG. 19, a throttle sensor 400 detects the throttle opening degree of a throttle 30 operatively connected to an accelerator pedal, and a A/F sensor in the form of $O_2$ sensor 402 is provided for each exhaust port. The outputs of the throttle sensor 400 and A/F sensor 402 are supplied to a microcomputer based control unit 50. This control arrangement shown in FIG. 19 is substantially the same as the first embodiment shown in FIG. 3 except for the provision of throttle sensor 400 and A/F sensor 402. According to this embodiment, solenoid actuators 44 for second valves 42 and fuel injectors 46 are actuated under the control of the control unit 50 such that the A/F ratio in each cylinder is brought into agreement with a target A/F ratio.

Figure 20:
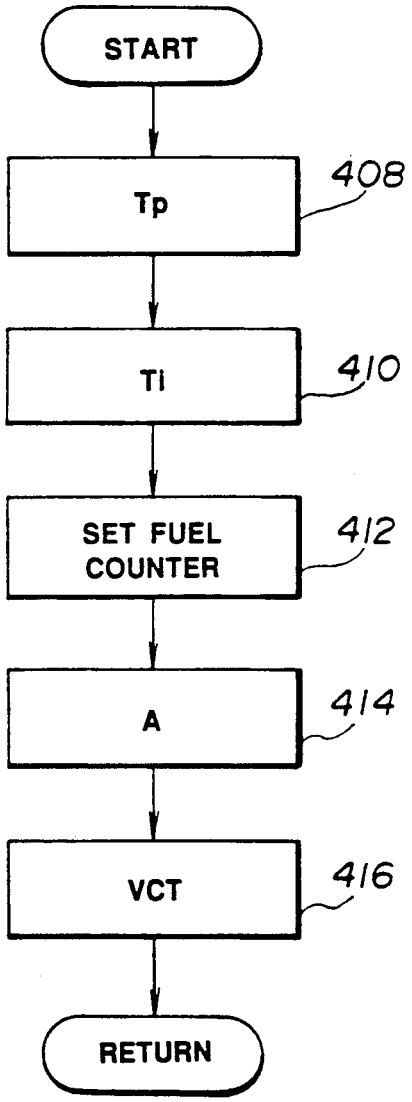
FIG. 20 is a flow diagram.
Figure 21:
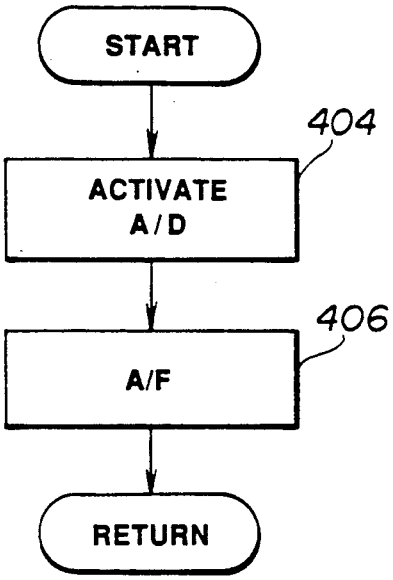
FIG. 21 is a flow diagram.

FIGS. 20 and 21 depict programs stored in the ROM of control unit 50. The execution of the program shown in FIG. 20 is initiated after a predetermined time, for example 5 msec., while the execution of the program shown in FIG. 21 is initiated when the crankshaft travels to the predetermined crank angles which are set for the cylinders, respectively. Referring to FIG. 21, when the crankshaft travels to a predetermined crank angle at which one of the cylinders is in the exhaust stroke, this program is executed and an A/D converter for the A/F sensor 402 for this cylinder is activated and an output of this A/D converter is stored as an actual A/F sensor output data for this cylinder (step 404). The average of these actual a/F sensor output data is calculated and stored as an actual air fuel ratio A/F for this cylinder (step 406). In this manner, actual air/fuel ratios for different cylinders are determined.

Referring to FIG. 20, at a step 408, a basic fuel injection amount Tp is determined after table look-up operation of a predetermined table against throttle opening degree TH and engine speed RPM. This amount Tp is common to all of the cylinders. At a step 410, a fuel injection amount Tp is determined by calculating the following equation:

$$Ti = Tp \times COEF \times ALPHA \times Ts.$$

where:

COEF is a correction coefficient which is a function of varying correction coefficients;

ALPHA is an air fuel ratio feedback coefficient; and

Ts is a correction factor due to voltage of the vehicle battery.

The fuel injection amount Tp determined at the step 410 is common to all of the cylinders.

At a step 412, a fuel injection period is determined from the fuel injection amount Tp and set at a fuel injection counter provided in the control unit 50. The fuel injectors 46 for different cylinders are actuated at appropriate crankshaft angles to inject fuel of the same amount Ti to intake ports 32 of the cylinders, consecutively, in accordance with the content of the fuel counter.

At a step 414, a shortage in intake air A is determined for each of the cylinders. The shortage A is a function of a ratio of a target volume of intake TA to an actual volume of intake air AA. This ratio is determined for each of the cylinders. The target volume TA is determined by calculating the following equation:

$$TA = Tp \times A/F_T,$$

where: $A/F_T$ is a target air fuel ratio.

The actual volume AA is determined by calculating the following equation:

$$AA = Tp \times A/F$$

where: A/F is an actual air fuel ratio determined per cylinder.

At a step 416, valve closing timing (VCT) OF second valve 42 is determined per cylinder based on the shortage A determined for the cylinder.

Referring to FIG. 22, it is described how valve closing timing VCT is determined per cylinder. In FIG. 22, a volume of intake air $Q_1$ when the second valve 42 is fully opened, and a volume of intake air $Q_2$ when the second valve 42 is fully closed are determined by performing table look-up operations of different tables against the throttle opening degree TH and engine speed RPM (see blocks 420 and 422). At a block 424, a difference delta Q is determined by subtracting $Q_2$ from $Q_1$. This difference delta Q is determined per cylinder. At a block 428, a ratio of A to delta Q is calculated per cylinder. At a block 430, a correction value C is determined by a table look-up operation of the table shown in FIG. 24. At a block 432, intake valve opening period (IVOP) is contained. At a block 434, the valve closing timing (VCT) is determined by calculating the following equation:

$$VCT = A/\text{delta}Q \times C \times IVOP.$$

The VCT is a crankshaft travel angle after the timing at which the intake valve 34 is opened.

FIG. 23 shows a volume of intake air into the cylinder during the intake valve opening period (IVOP) with the second valve 42 fully opened. As readily seen from FIG. 23, the volume of intake air increases as shown by the fully drawn curve in response to an increase in the valve closing timing (VCT) of the second valve 42.

What is claimed is:

1. A multi-cylinder internal combustion engine, comprising:

a plurality of cylinders;

a plurality of pistons respectively reciprocably disposed in said cylinders;

a plurality of intake valves respectively mounted to control an intake of air and fuel into said cylinders;

a plurality of exhaust valves respectively mounted to said cylinders;

an intake system including individual intake ports, each intake port communicating with an associated one of said cylinders during an intake valve opened time period for any said one cylinder, said intake system including a throttle valve for each cylinder, and additional valve means for admitting air to each of said intake ports downstream of said throttle valve; and means for controlling an effective flow area of said additional valve means through which air is admitted to each of said intake ports downstream of said throttle valve such that, when said throttle valve is substantially closed, said effectively flow area is greater during said intake valve closed time period than it is during the intake valve opened time period.

2. A multi-cylinder internal combustion engine as claimed in claim 1, further including a bypass passage arranged in parallel to each of said throttle valves, said additional valve means being respectively disposed in said bypass passages.

3. A multi-cylinder internal combustion engine as claimed in claim 1, further including a bypass opening arranged in parallel to each of said throttle valves.

4. A multi-cylinder internal combustion engine as claimed in claim 2, wherein said controlling means includes a solenoid operated actuator operatively connected for controlling each said additional value means.

5. A multi-cylinder internal combustion engine as claimed in claim 3, wherein said controlling means includes said additional value mena in the form of a throttle valve disposed in said bypass opening.

6. A multi-cylinder internal combustion engine as claimed in claim 2, wherein said controlling means further includes means for calculating cylinder output torque for each said cylinder and controlling solenoid operated actuators, connected to regulate said additional valve means, in response to said calculated cylinder output torque.

7. A mutli-cylinder internal combustion engine as claimed in claim 2, wherein said controlling means includes means for determining the air-fuel ratio in each cylinder and controlling solenoid operated actuators, connected to regulate said additional valve means in rspnse to said air fuel ratios.

* * * * *